US007299728B2

(12) United States Patent
Ferrin et al.

(10) Patent No.: US 7,299,728 B2
(45) Date of Patent: Nov. 27, 2007

(54) LOAF END TRIMMING STATION FOR SLICING MACHINE

(75) Inventors: Judd Ferrin, Willowbrook, IL (US); Glenn Sandberg, New Lenox, IL (US)

(73) Assignee: Formax, Inc., Mokena, IL (US)

( * ) Notice: Subject to any disclaimer, the term of this patent is extended or adjusted under 35 U.S.C. 154(b) by 51 days.

(21) Appl. No.: 11/112,969

(22) Filed: Apr. 22, 2005

(65) Prior Publication Data

US 2006/0196336 A1 Sep. 7, 2006

Related U.S. Application Data

(60) Provisional application No. 60/659,344, filed on Mar. 5, 2005.

(51) Int. Cl.
*B26D 7/06* (2006.01)
*B26D 1/03* (2006.01)

(52) U.S. Cl. ..... 83/119; 83/42; 83/84; 83/167; 83/276; 83/279; 83/411.4; 83/858; 83/932; 198/347.1

(58) Field of Classification Search ..... 83/42, 83/43, 84, 86, 119, 167, 218, 276, 278, 279, 83/280, 435.17, 509, 535, 564, 858, 932, 83/410, 411.4, 410.7; 414/794.3, 789, 794, 414/287, 222.02, 744.2; 198/347.1, 456, 198/550.2

See application file for complete search history.

(56) References Cited

U.S. PATENT DOCUMENTS 262,611 A * 8/1882 Nichols et al. ..... 83/411.6
316,301 A * 4/1885 Stahl ..... 83/705
933,965 A * 9/1909 Endres ..... 83/411.4
1,123,056 A * 12/1914 Stahl ..... 83/112
1,761,984 A * 6/1930 Frick ..... 83/409
2,247,693 A * 7/1941 Papendick ..... 83/407
3,250,162 A * 5/1966 Bunting ..... 83/23
3,330,401 A * 7/1967 Lennart ..... 198/463.5
3,888,150 A * 6/1975 Stroud et al. ..... 83/368
4,082,025 A * 4/1978 Reinbacher ..... 83/411.4
4,398,580 A * 8/1983 Sohn et al. ..... 144/357

(Continued)

OTHER PUBLICATIONS

Prior Sale FORMAX Model 17830-M Docker, 3 blueprints (27 sheets), Nov. 16, 1987.

(Continued)

*Primary Examiner*—Boyer D. Ashley
*Assistant Examiner*—Edward Landrum
(74) *Attorney, Agent, or Firm*—The Law Office of Randall T. Erickson, P.C.

(57) ABSTRACT

A loaf end trimming station for a high speed food loaf slicing machine, includes a frame, a first knife and a second knife spaced apart along the frame and oriented in positions corresponding to a lead end trimming location and a trailing end trimming location of a food loaf. The trimming station includes a loaf cutting support for receiving the loaf, and a motive mechanism to move the loaf cutting support toward the knives to trim ends off of the loaf. The trimming station includes a loaf staging support, wherein the loaf cutting support deposits the loaves on the loaf staging support after being trimmed by the knives. The loaf staging support is tiltable between a staging position to collect trimmed loaves and a loading position to deliver trimmed loaves to the high speed food loaf slicing machine.

14 Claims, 14 Drawing Sheets

U.S. PATENT DOCUMENTS

| | | | | |
|---|---|---|---|---|
| 4,512,137 | A * | 4/1985 | Koberlein | 53/435 |
| 5,628,237 | A * | 5/1997 | Lindee et al. | 83/403.1 |
| 5,951,238 | A * | 9/1999 | Duecker | 414/794.9 |
| 5,974,925 | A * | 11/1999 | Lindee et al. | 83/412 |
| 6,409,011 | B1 * | 6/2002 | Ferguson | 198/861.3 |

OTHER PUBLICATIONS

Prior Sale FORMAX Model 17318-M Docker, 5 Blieprints (35 sheets) Jan. 14, 1987.
Prior Sale FORMAX Model 45826-M (11 sheets), May 7, 1999.
Prior Sale FORMAX Model 51307-M Docker (14 sheets), Apr. 11, 2002.

* cited by examiner

PRIOR ART

LOAF END TRIMMING STATION FOR SLICING MACHINE

This application claims the benefit of U.S. Provision Application Ser. No. 60/659,344 filed Mar. 5, 2005.

BACKGROUND OF THE INVENTION

Many different kinds of food loaves are produced; they come in a wide variety of shapes and sizes. There are meat loaves made from various different meats, including ham, pork, beef, lamb, turkey, and fish. The meat in the food loaf may be in large pieces or may be thoroughly committed. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Typically the food loaves are sliced, the slices are grouped in accordance with a particular weight requirement, and the groups of slices are packaged and sold at retail. The number of slices in a group may vary, depending on the size and consistency of the food loaf and the desire of the producer, the wholesaler, or the retailer. For some products, neatly aligned stacked slice groups are preferred. For others, the stacks are shingled so that a purchaser can see a part of every slice through a transparent package.

Food loaves can be sliced on high speed slicing machines such as disclosed in U.S. Pat. Nos. 5,628,237 or 5,974,925 or as commercially available as the FX180™ slicer available from Formax, Inc. of Mokena, Ill., U.S.A.

The FX180™ machine can be configured as an automatically loaded, continuous feed machine. In the FX180™ machine, side-by-side upper and lower conveyor pairs drive loaves into the cutting plane. A gate is located in front of the conveyors. The initial loaves are loaded with leading ends abutting the gate. The gate is lowered and the loaves proceed into the conveyors. When the initial loaves are sliced to the extent that the trailing ends of the loaves clear the gate, the gate is raised and new loaves are loaded in the feed paths, held back by the gate. Shortly thereafter the gate is lowered and new loaves slide down to where lead ends of the new loaves abut trailing ends of the initial loaves being sliced. The new loaves are driven into the cutting plane trailing the initial loaves. Loaves are sequentially and continuously loaded in this manner, lead end-to-trailing end, in abutting contact with the preceding loaves.

One problem associated with this arrangement is the fact that for loaves to be properly loaded into a continuous slicing machine, the loaves must have their ends trimmed to a flat condition so the loaves will fit flushly against preceding loaves. Thus, the noticeable interface or seam between successive loaves, where slices can be ragged or irregular, can be minimized.

SUMMARY OF THE INVENTION

The invention provides a trimming station for a continuously loaded high speed food loaf slicing machine. The trimming station can include a frame, a first knife and a second knife spaced apart along the frame and oriented in positions corresponding to a lead end trimming location and a trailing end trimming location of a food loaf. The trimming station can also include a loaf cutting support for receiving the loaf, and a motive mechanism to move one of the knives or the loaf cutting support toward the respective other of the knives or the loaf cutting support to trim ends off of the loaf.

The invention is particularly useful for a trimming station that includes a loaf staging support, wherein the loaf cutting support deposits the loaves on the loaf staging support after being trimmed by the knives. The loaf staging support is movable between a staging position to collect trimmed loaves and a loading position to deliver trimmed loaves to the cutting path.

The invention is particularly useful for high speed food loaf slicing machine, wherein the cutting path holds plural loaves side-by-side, and the loaf feed drive comprises plural loaf feed drives that drive the loaves independently into a cutting plane.

The invention is particularly useful for a high speed food loaf slicing machine, wherein the slicing station comprises a loaf loading tray for receiving loaves from the staging support, a loading mechanism for moving the loaf loading tray to a position adjacent to the cutting path, and a displacement mechanism for moving the loaves from the loaf loading tray onto the cutting path.

The invention is particularly useful for a trimming station wherein the loaf cutting support is pivotally mounted on the frame, and the knives are fixedly mounted to the frame, and a pneumatic cylinder is connected between the loaf cutting support and the frame, wherein movement of the pneumatic cylinder pivots the loaf cutting support to drive the knives through the loaf held thereon.

The invention is particularly useful for a trimming station wherein the knives are adjustable in position on the frame along a direction along the length of the loaf held on the loaf cutting support.

The invention is particularly useful for a trimming station comprising an end stop on the loaf cutting support, the end stop being adjustable in position on the loaf cutting support along a direction parallel to a length of the loaf held on the loaf cutting support.

Numerous other advantages and features of the present invention will be become readily apparent from the following detailed description of the invention and the embodiments thereof, and from the accompanying drawings.

DESCRIPTION OF THE PREFERRED EMBODIMENTS

Figure 1:
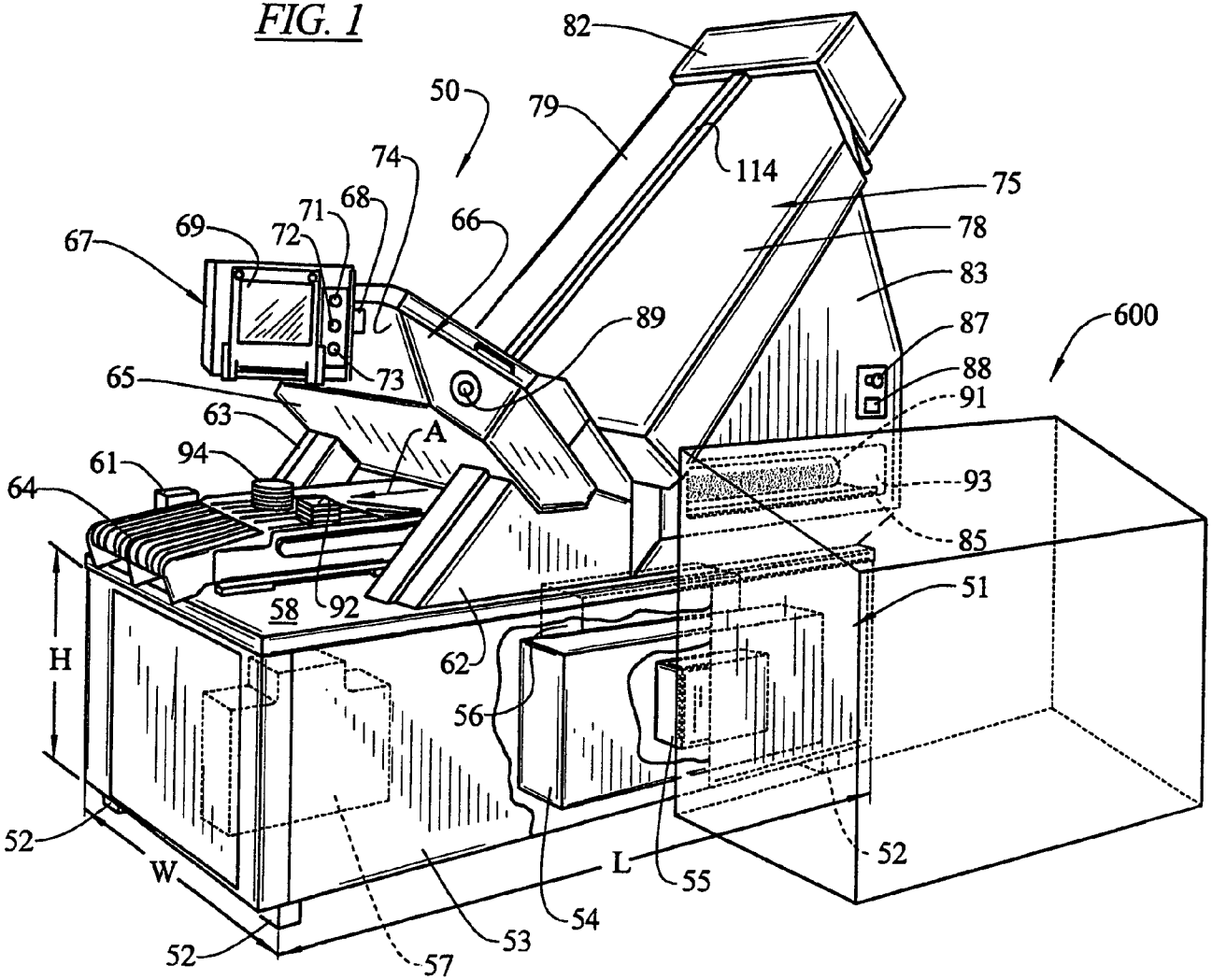
FIG. 1 is a perspective view of a slicing machine comprising a preferred embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a food loaf slicing machine 50 and a cooperating loaf trimming station 600 (shown as a block and described in detail below). The slicing machine can be constructed in accordance with U.S. Pat. Nos. 5,628,237 or 5,974,925 herein incorporated by reference and modified for continuous loaf feed and automatic loading, such as is commercially available as the FX180™ slicer available from Formax, Inc. of Mokena, Ill., U.S.A. Slicing machine 50 comprises a base 51 which is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also enclose a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45 degrees and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing head 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71-73 and display/touch screen 69 are electrically connected to computer 54 in base 51.

The upper right-hand portion of slicing machine 50, as seen in FIG. 1, comprises a loaf feed mechanism 75 which includes an automated feed from the left-hand (near) side of the machine. Loaf feed mechanism 75 has an enclosure that can include a far-side manual loaf loading door 79 and a near-side automatic loaf loading door 78. Slicing machine 50 is equipped for automated loading of loaves from the near-side, as seen in FIG. 1, and can include manual loading of food loaves on the far-side of the machine. It will be understood that automated loaf loading may be provided on either or both sides of the machine.

A loaf feed guard 83 protects the nearside of the loaf feed mechanism 75 and shields mechanism 75 from a machine operator. There may be a similar guard on the opposite side of the machine. Behind loaf feed guard 83 there is a loaf lift tray 85 employed to load a food loaf into mechanism 75 during an automated loaf loading operation in machine 50 as described in detail below.

There are some additional switches seen in FIG. 1. An emergency stop switch 87 for interrupting all operations of slicing machine 50 is mounted on the near side of loaf feed guard 83. There may be a similar emergency stop switch on the opposite side of the machine. A loaf lift switch 88 for initiating automated loading of a loaf from tray 85 into mechanism 75 is located immediately below switch 87. An emergency stop switch 89 is mounted on slicing station 66 on the near-side of machine 50. Switches 87, 88, and 89, and any counterparts on the opposite (far) side of slicing machine 50, are all electrically connected to the controls in enclosure 54.

As shown in FIG. 1, slicing machine 50 is ready for operation. There are food loaves 91 on tray 85, viewed through an opening or window 93 through the guard 83, waiting to be loaded into loaf feed mechanism 75 on the near-side of machine 50. Two, three, or even four food loaves may be stored on tray 85, depending on the loaf size. Machine 50 produces a series of stacks 92 of food loaf slices that are fed outwardly of the machine, in the direction of the arrow A, by conveyor classifier system 64. Machine 50 also produces a series of stacks 94 of food loaf slices that also move outwardly of the machine on its output conveyor system 64 in the direction of arrow A. Stack 92 is shown as comprising slices from a rectangular loaf, and stack 94 is made up of slices from a round loaf. Usually, both of the slice stacks 92 and 94 would be either round or rectangular. Stacks 92 and 94 may have different heights, or slice counts, and hence different weights; as shown they contain the same number of food loaf slices in each stack, but that condition can be changed. Both groups of slices can be overlapping, "shingled" groups or stacks of slices instead of having the illustrated straight stack configuration. Two, three or more loaves can be sliced simultaneously.

Figure 2:
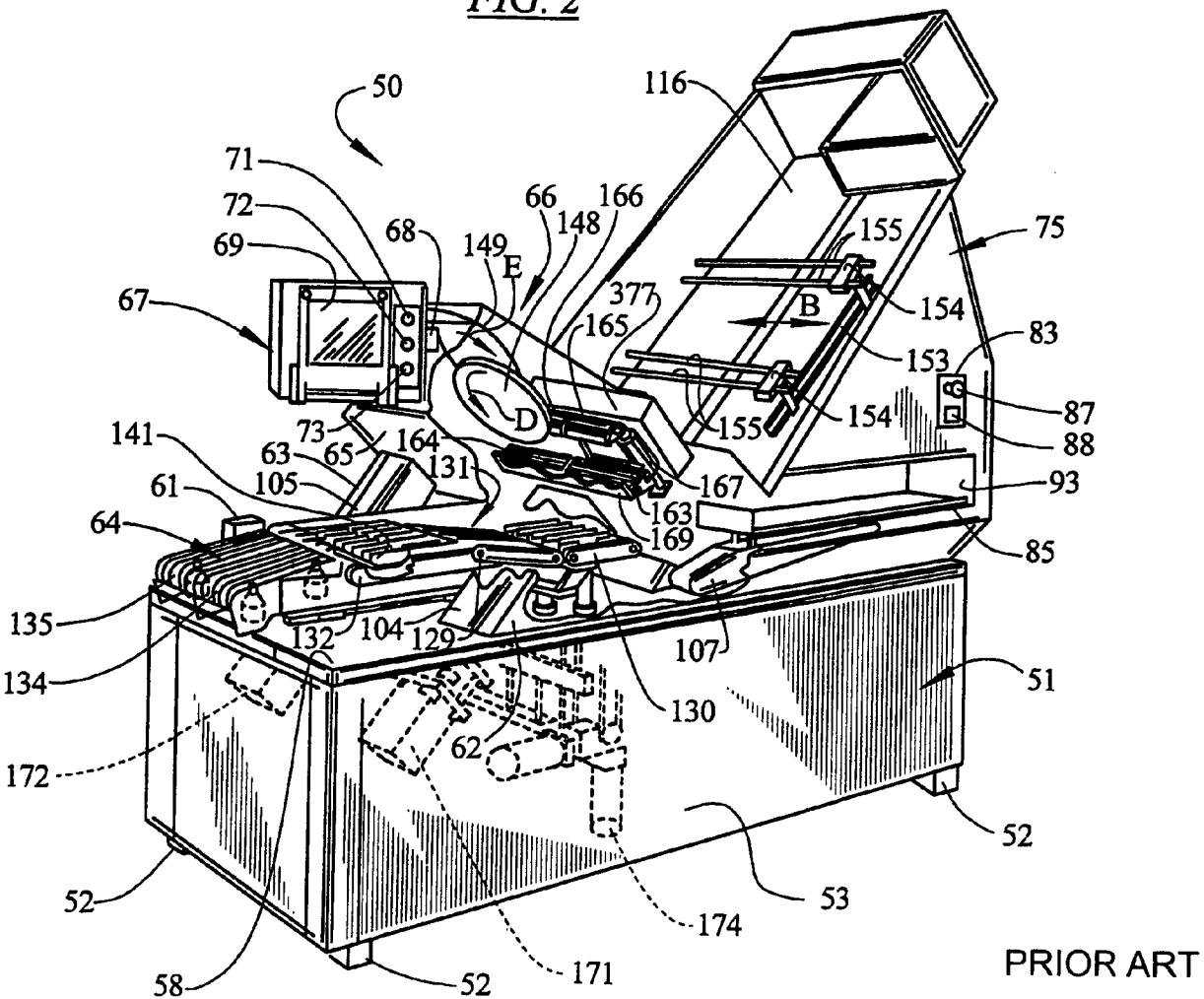
FIG. 2 PRIOR ART
FIG. 2 is a perspective view of a slicing machine comprising a preferred embodiment of the invention, with portions of the covers on the machine base cut away.

FIG. 2 illustrates the slicing machine 50 of FIG. 1 with a number of the covers omitted to reveal operating components of the automated loaf feed mechanism 75 on the near-side of the machine. As shown in FIG. 2, there is a stack/shingle conveyor drive 101 located on the near-side of slicing machine 50. One part of the drive for slicing station 66 is enclosed within a support enclosure 104 on the near-side of machine 50. At the opposite side of slicing machine 50 there is an enclosure 105 for a knife drive. Slicing station drive enclosure 104 and knife drive enclosure 105 extend upwardly from table top 58 at an angle, preferably approximately 45 degrees, corresponding to the angular alignment of mechanism 75.

A loaf tray pivot mechanism 107 is located above top 58 of base 51 on the near-side of slicing machine 50. Mechanism 107 is connected to and operates the automatic loaf lift tray 85, as described below. A similar loaf tray pivot mechanism may be provided on the opposite side of slicing machine 50 in a machine equipped for automated loaf loading from both sides.

The principal support for one or more food loaves in mechanism 75, whether food loaf loading is being carried out on an automated basis or on a manual feed basis, includes a loaf support tray 116 that provides a continuous loaf support surface that is the bottom for the two or more loaf paths in slicing machine 50. A textured upper surface is preferred for support member 116 to improve sliding movement of a food loaf along those support members toward slicing station 66.

FIG. 2 illustrates the general arrangement of operating components within slicing head 66, one construction that may be used for conveyor/classifier system 64, and the drive motors for parts of slicing machine 50.

Referring first to conveyor/classifier system 64 at the left-hand (output) end of slicing machine 50, it is seen that system 64 includes an inner stacking or receiving conveyor 130 located immediately below slicing head 66; conveyor 130 is sometimes called a "jump" conveyor in some versions of machine 50. From conveyor 130 groups of food loaf slices, stacked or shingled, are transferred to a decelerating conveyor 131 and then to a weighing or scale conveyor 132. From the scale conveyor 132 groups of food loaf slices move on to an outer classifier conveyor 134. On the far side of slicing machine 50 the sequence is the same, but that side of system 64 ends with a second outer classifier conveyor 135 located next to conveyor 134.

Slicing station 66 is shown to include a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion while it rotates. Other slicing head constructions may be used in machine 50, so long as the cutting edge of knife blade 149 moves along a predetermined cutting path in each cycle of operation. Involute-shaped blades such as described in U.S. Pat. No. 6,484,615, herein incorporated by reference, can also be used.

Loaf feed mechanism 75 further comprises a near-side sweep member 153 suspended from two sweep carriages 154 which in turn are each mounted upon a pair of sweep support rods 155. Sweep mechanism 153-155 is employed on the near side of machine 50. A corresponding sweep mechanism (not shown) may be located on the far side of a slicing machine equipped for automated loaf loading from both sides. Sweep carriages 154 are driven along rods 155 by belts, not shown in FIG. 2, as indicated by arrows B. Rods 155 are connected to a rotatable sweep actuator 156 for actuation thereby.

Slicing machine 50 further comprises a system of short conveyors for advancing food loaves from loaf feed mechanism 75 into slicing head 66. The short conveyor systems are actually a part of loaf feed mechanism 75. FIG. 2 shows two short lower loaf feed conveyors 163 and 164 on the near and far-sides of slicing machine 50, respectively. These short lower conveyors 163 and 164 are located immediately below two short upper feed conveyors 165 and 166, respectively. As used in describing conveyors 163-166, the term "short" refers to the length of the conveyors parallel to the food loaf paths along support 116-118, not to the conveyor lengths transverse to those paths. The upper conveyor 165 of the pair 163 and 165 is displaceable so that the displacement between conveyors 163 and 165 can be varied to accommodate food loaves of varying height. This adjustment is provided by a conveyor lift actuator 167 that urges conveyor 165 downwardly. A similar conveyor actuator is located on the far-side of machine 50 to adjust the height of the other upper short conveyor 166; the second actuator cannot be seen in FIG. 2.

The conveyor delivers the loaf leading ends into a shear edge and orifice member 169, described in detail in U.S. Pat. No. 5,974,925.

Some of the drive motors for the operating mechanisms in slicing machine 50 are shown in FIG. 2. The drive motor for the head or spindle 148 in slicing station 66 is a D.C. variable speed servo motor 171 mounted in the machine base 51. A similar servo motor 172 drives the knife blade 149. On the near side of machine 50 the loaf feed drive mechanism comprising the short loaf feed conveyors 163 and 165 is driven by a servo motor 174. A like motor 175 on the far side of machine 50 (not shown in FIG. 2) affords an independent drive for the "short" loaf feed conveyors 164 and 166 on that side of the slicing machine; see FIG. 4.

Figure 3:
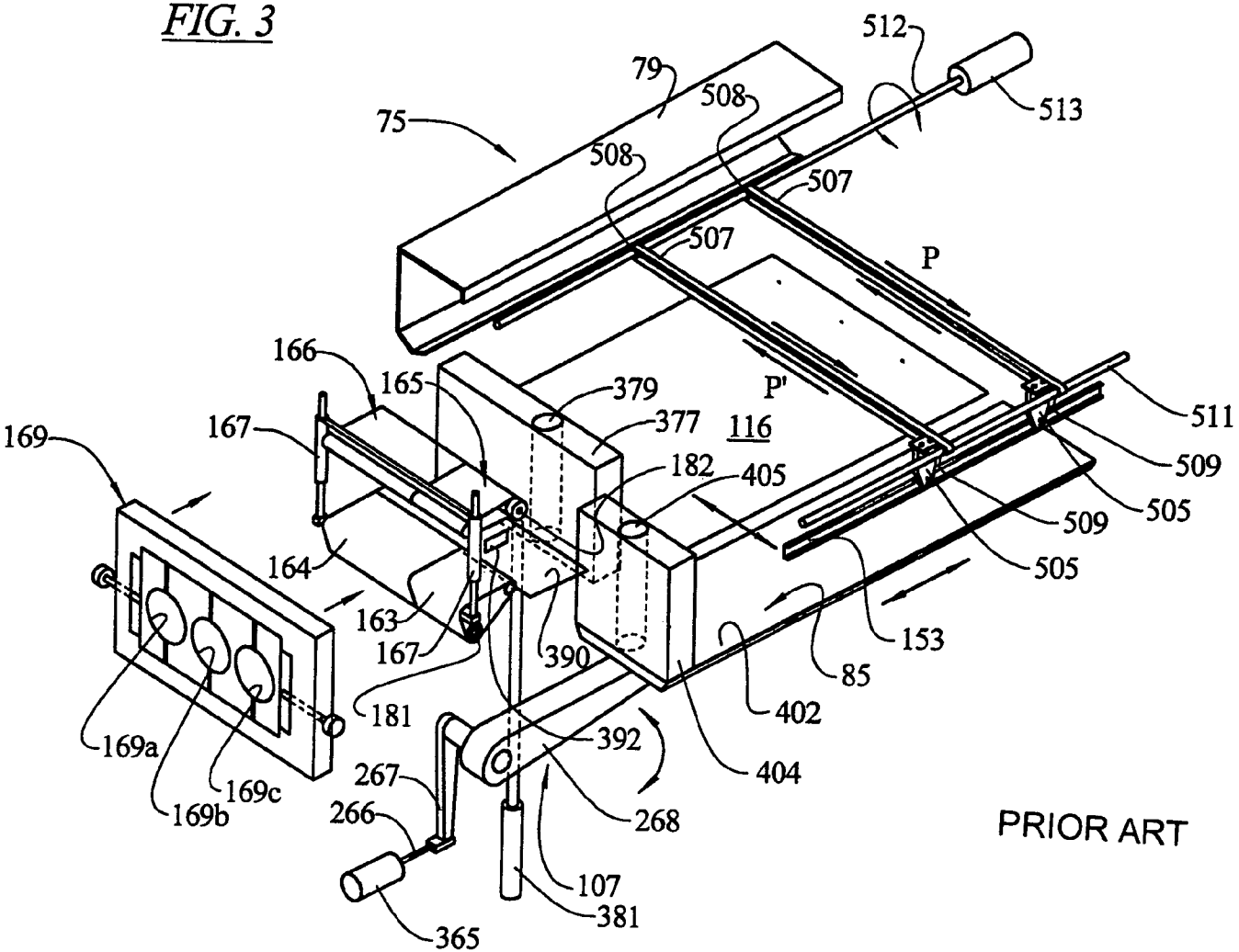
FIG. 3 is a simplified perspective view of operating components of the slicing machine of FIG. 1.

FIG. 3 affords a simplified schematic illustration of most of the loaf loading and loaf feed mechanisms in the slicing machine. Starting at the left-hand side of FIG. 3, it is seen that there is a loaf lift cylinder 365 having an actuating rod 266 connected to a crank 267 that in turn drives a loaf lift lever 268. These members are a part of the loaf lift mechanism 107 that lifts storage tray 85 from its storage position (FIGS. 1-2) into alignment with the support 116 on which food loaves rest during slicing. The loaf lift mechanism is actuated only during loaf loading; during a loaf feeding/slicing operation, cylinder 365 is not normally actuated and keeps tray 85 in its storage position. However, tray 85 may be elevated, ready to load a new loaf or loaves into feed mechanism 75, near the end of slicing.

The tray 85 includes a support surface 402 and an end wall 404. The end wall is shown schematically. It includes a plurality of vertically oriented rollers 405 (one shown) which reduce lateral drag on the loaves as they are transferred onto and off of the tray 85.

Figure 4:
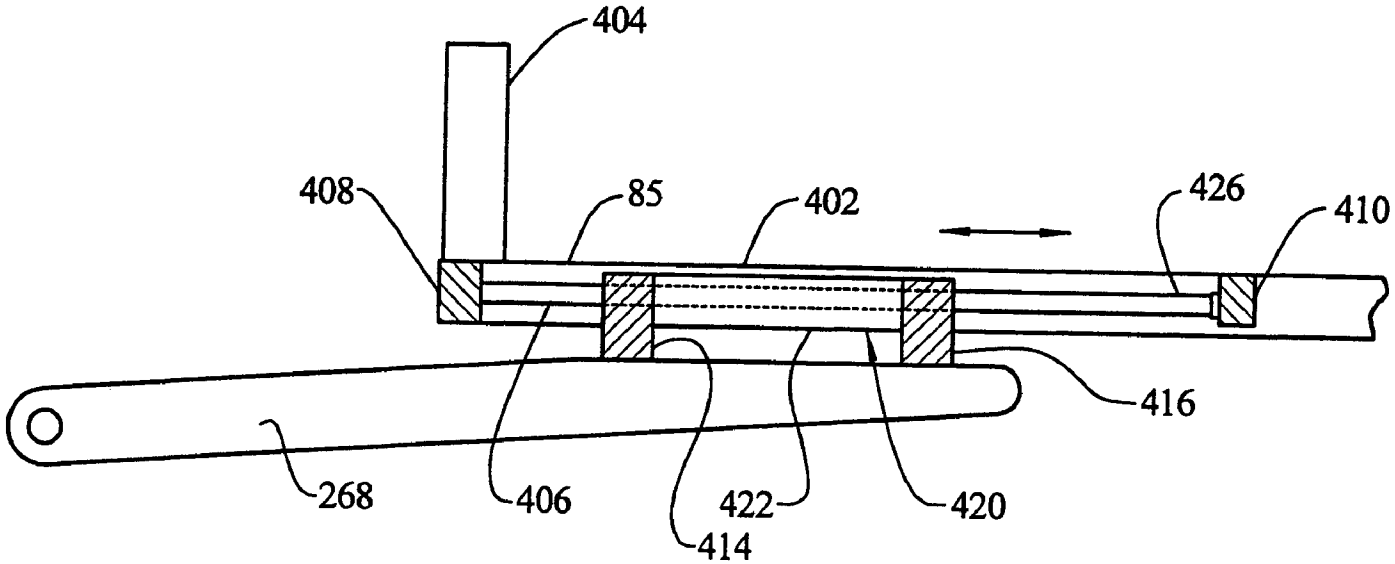
FIG. 4 is a simplified sectional view taken generally along line 44 of FIG. 2.
Figure 5:
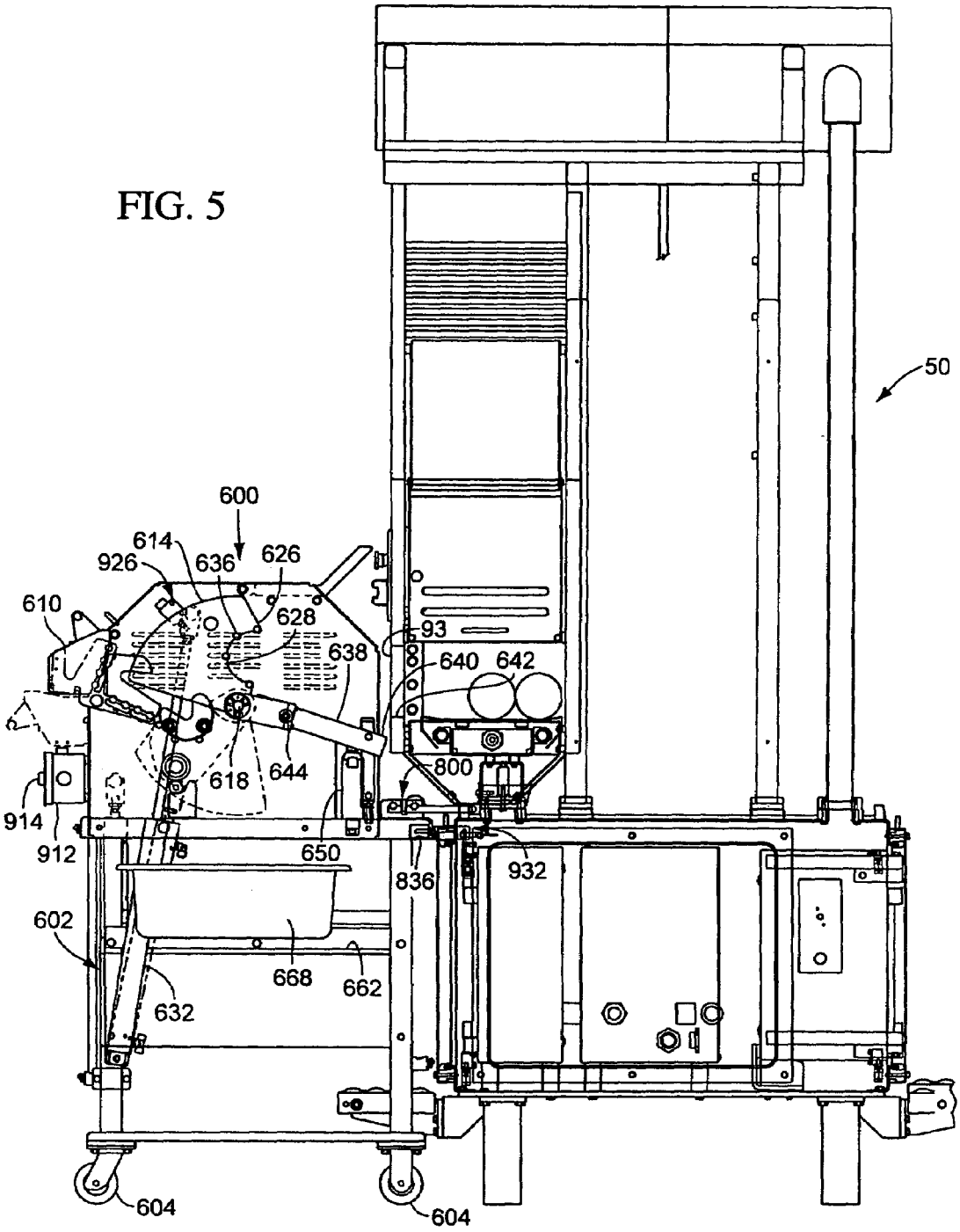
FIG. 5 is a right side view of the slicing machine and loaf trimming station with panel portions removed to view inside components.

FIG. 4 illustrates in schematic from that the tray is mounted on a pair of parallel guide rods (one shown) 406 that are fixed at their ends to blocks or parts 408, 410 of the tray 85. The rods 46 are guided for sliding through brackets 414, 416 that are fixed to the lever 268. A pneumatic cylinder 420 has a cylinder portion 422 fixed between the brackets 414, 416 and a piston rod 426 that extends from the bracket 416 to the block 410 and is fixed to the latter. Thus extension or retraction of the rod 426 slides the tray 85 along the lever 268, along the rods 406.

The tray 85 is configured to be slidable on the bracket 268 so as to handle long loaves while minimizing the required machine longitudinal length and "foot print" when the tray is in the loading position (horizontal).

Returning to FIG. 3, the "short" conveyors 163-166, with the two upper "short" conveyors 165 and 166 are mounted on the housings of cylinders 167. Cylinders 167 have fixed shafts; air applied under pressure to the cylinders tends to drive their housings, and hence conveyors 165 and 166 down toward the lower conveyors 163 and 164. Downward movement of the upper conveyors is blocked by the shear edge member 169 that is specific to the size of loaves being sliced, so that each pair of the conveyors engages opposite sides (top and bottom) of a food loaf being sliced.

The sweep 153 is suspended from two hangers/carriages 505, each connected to a drive belt 507. There are structural members, not shown in FIG. 3, that afford further support for the hanger-carriages. Belts 507 are timing belts, each engaging a drive pulley 508 and an idler pulley 509. The idlers 509 are mounted on a shaft 511. The drive pulleys 508 are affixed to a shaft 512 rotated by a loaf sweep motor 513.

When a food loaf is first placed on support 116 it may tend to slide down toward slicing station 66; the support member 116 of transfer mechanism 75 is at an angle of 45 degrees as shown in FIGS. 1-2. The upper surfaces of the support member preferably have a textured finish to facilitate sliding of the food loaf. Each loaf path is closed off, near the slicing station 66, by the gate 377. Thus, a loaf entering mechanism 75 cannot slide down unexpectedly and prematurely into slicing station 66. The gate 377 comprises a plurality of rollers 379 (one shown), oriented in a direction perpendicular to the surface of the support tray 116, that allow the loaves to slide transversely with low friction drag in the lateral direction, from the loading tray 85 to the support tray 116. The gate 377 is raised and lowered by one or more pneumatic cylinders 381.

Between the gate 377 and the conveyors 163-166 a support 390 is provided having tapered lane dividers 392 which guide loaves laterally to move along pre-selected loaf paths into the conveyors. The orifice plate 169 also has side guides to direct the loaves into the corresponding orifices.

FIG. 3 illustrates a setup to slice three side-by-side loaves. Two loaves are driven by the conveyors 164, 166 and one loaf is driven by the conveyors 163, 165.

The orifice plate 169 is arranged closely adjacent to the downstream side of the conveyors and includes two or more orifices 169*a*, 169*b*, 169*c* for guiding two or more loaves into the cutting plane. The orifice plate 169 is more completely described in U.S. Pat. No. 5,974,925 herein incorporated by reference.

At the beginning of an automated loaf loading operation, the loaf loading tray 85 is moved up to the position shown in FIG. 3, aligning loaves carried on the tray surface 402 with the support 116 on which the loaves rest while being sliced. The drive for pulley 508 and shaft 512 operates to drive the upper run of belt 507 to the right, in FIG. 3, in the direction indicated by arrows P. This moves the lower run of belt 507 toward the center of the slicing machine, to the left as seen in FIG. 3. The belt movement drives carriage 154 and suspension member 505 to the left along shafts 155 (FIG. 2) and moves sweep 153 pushing the new loaves onto the support 116 and into the loaf cutting paths of the slicing machine. The support can have surface contours and/or guides that substantially align the loaves into pre-selected side-by-side cutting paths.

The loaves rest against the gate 377, which is in the raised position. Thereafter, the gate 377 is lowered and the loaves slide down the support 116 until the lead ends of the loaves abut the trailing ends of the preceding loaves being sliced. If the loaves are the initially loaded loaves, i.e., there are no preceding loaves to which the initially loaded loaves can abut, the loaves slide down into the conveyors.

In order for the preceding and subsequent loaves to flushly butt end-to-end, and in order to ensure continuous, relatively smooth, slicing through the seams located between sequentially fed loaves, squared off, trimmed ends are required for the loaves.

Figure 6:
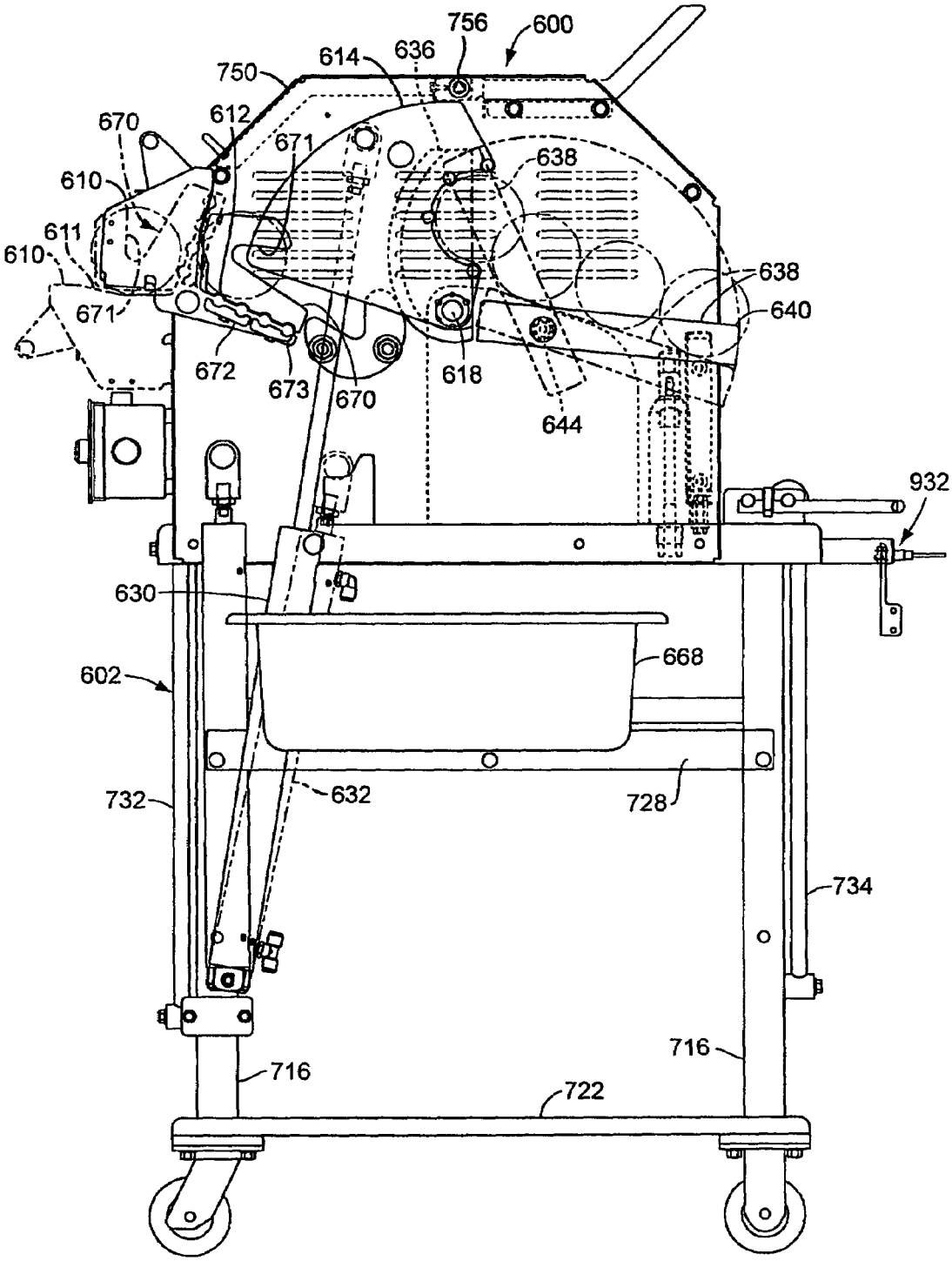
FIG. 6 is an enlarged view of the loaf trimming station of FIG. 5 with panel portions removed to display inside components.
Figure 7:
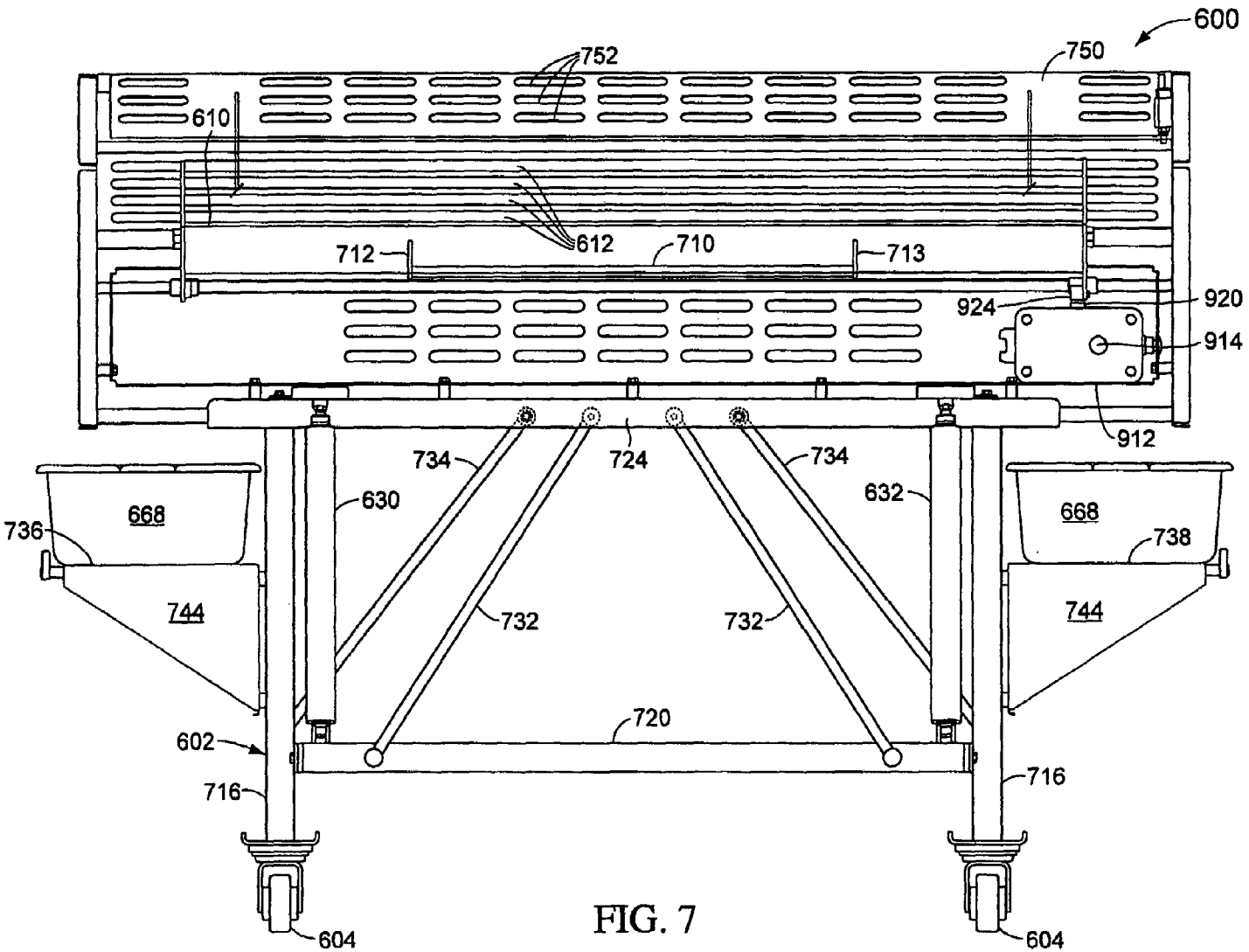
FIG. 7 is a front view of the loaf trimming station shown in FIG. 1.

FIGS. 5-9 illustrate an automated loaf trimming station 600 in accordance with the present invention. The loaf trimming station includes a frame 602 supported on wheels 604. The frame 602 is releasably attached to the base 51 of the slicing machine 50 as described below. The frame 602 supports a loading tray door 610. The loading tray door 610 is pivotally attached to the frame 602 to be moved from an open position for receiving a loaf, to a closed position wherein the loaf is deposited onto a pivotal loaf cutting support 614. The door 610 includes a receiving support 611 and a plurality of discharge bars 612. FIG. 7 illustrates the door 610 comprises a handle 710 mounted to two brackets 712, 713.

The pivotal loaf cutting support 614 is pivotally attached to the frame 602 about a shaft 618. The loaf cutting support 614 includes spaced-apart end plates 622, 624 connected together by spaced-apart bars 626 that define a concave region 628 for cradling the loaf received from the door 610. A stop plate 629 is mounted adjacent to the plate 622 as described below.

Two pneumatic cylinders 630, 632 are rotationally connected to a bar 633 that spans between and is fixed to the plates 622, 624 at a point distant from the shaft 618. The pneumatic cylinders are connected to a lower portion of the frame 602. Extension of the cylinders causes upward rotation of the loaf cutting support 614 about the shaft 618.

A pair of loaf-cutting knives 634, 636 are arranged adjacent to the lead end and trailing end respectively of the loaf supported on the bars 626. The knives 634, 636 are mounted stationary with respect to the frame 602 and are located such that when the loaf cutting support 614 is pivoted upwardly, the knives pass through the loaf near to the lead and trailing ends to trim and square the ends of the loaf to a pre-selected loaf length. After the loaf passes the knives and is thereby trimmed, the loaf falls by gravity onto a loaf-staging support 638.

The loaf staging support 638 includes a discharge edge 640 that is lower than a lower lip 642 of the loaf receiving window 93. Thus, the first cut loaf is retained against the base 51. Subsequent cut loaves are stacked against the first cut loaf. The loaf staging support 638 is pivotally mounted on a shaft 644 to the frame 602. Two pneumatic cylinders 650, 652 are located between the frame 602 and the loaf-staging support 638. When a pre-selected number of loaves are collected on the loaf-staging support 638, the cylinders 650, 652 are extended to rotate the support 638 and elevate the edge 640 to be above the lip 642 of the window 93 of the slicing machine. The loaves, under force of gravity, roll and/or slide onto the tray 85. The loaves are now ready for loading into the slicing apparatus 50.

FIG. 6 illustrates that the loaf-staging support 638 can be rotated counterclockwise to about a 120 degree orientation for cleaning.

An intermediate support 662 is provided beneath each of the knives 634, 636, and is configured to hold a bucket or bin 668 to collect sliced end portions 903 (FIG. 10C) from the loaves.

A screw thread arrangement 669 is provided between the knives 634, 636 and the frame 602 for adjustment of the longitudinal position of the knives with respect to the loaf to be trimmed. The arrangement is described in more detail below.

An adjustable stop for one end of the loaf to be cut provides a datum for setting the sliced length of the loaves. The stop can be used either at the lead end of the loaf (the left side of FIG. 9) or the trailing end of the loaf (the right side of FIG. 9). This arrangement comprises a stop plate 670 having a V or U-shaped notch 671. The V or U-shaped notch 671 allows a protruding end closure or tie-off of the loaf casing to pass through the plate so that irregularities in the length, or bulk, or compression of the end closure do not effect the cut length of the loaf. The plate 670 is clamped to the bars 612 via two clamps 672, 673, fastened between the bars 612 and into the stop plate 670. The plate 670 can thus be selectively located along the bars 612 by loosening the clamps 672, 673, sliding the plate 670 along the bars 612 and retightening the clamps. The plate 670 can be located at either of the door 610.

The frame 602 includes four columns 716, longitudinal lower rails 720, side lower rails 722, upper platform 724, side intermediate rails 728, front diagonal braces 732 and rear diagonal braces 734.

The pneumatic cylinders 630, 632 are connected a bottom ends to the front longitudinal rail 720. End platforms 736, 738 are connected to the columns 716 and supported by knee plates 744. The platform 736, 738 support the end trimmings bins 668.

An upper lid 750 is tilted up about an axis attachment 756 to gain access into the station 600. The lid 750 has oblong holes 752 throughout that allow observation of the inside of the station 600.

Left and right plastic support blocks 745, 746 are fastened to the platform 724. The shafts 618 and 644 penetrate through and are rotationally guided and supported by the blocks 745, 746.

Figure 8:
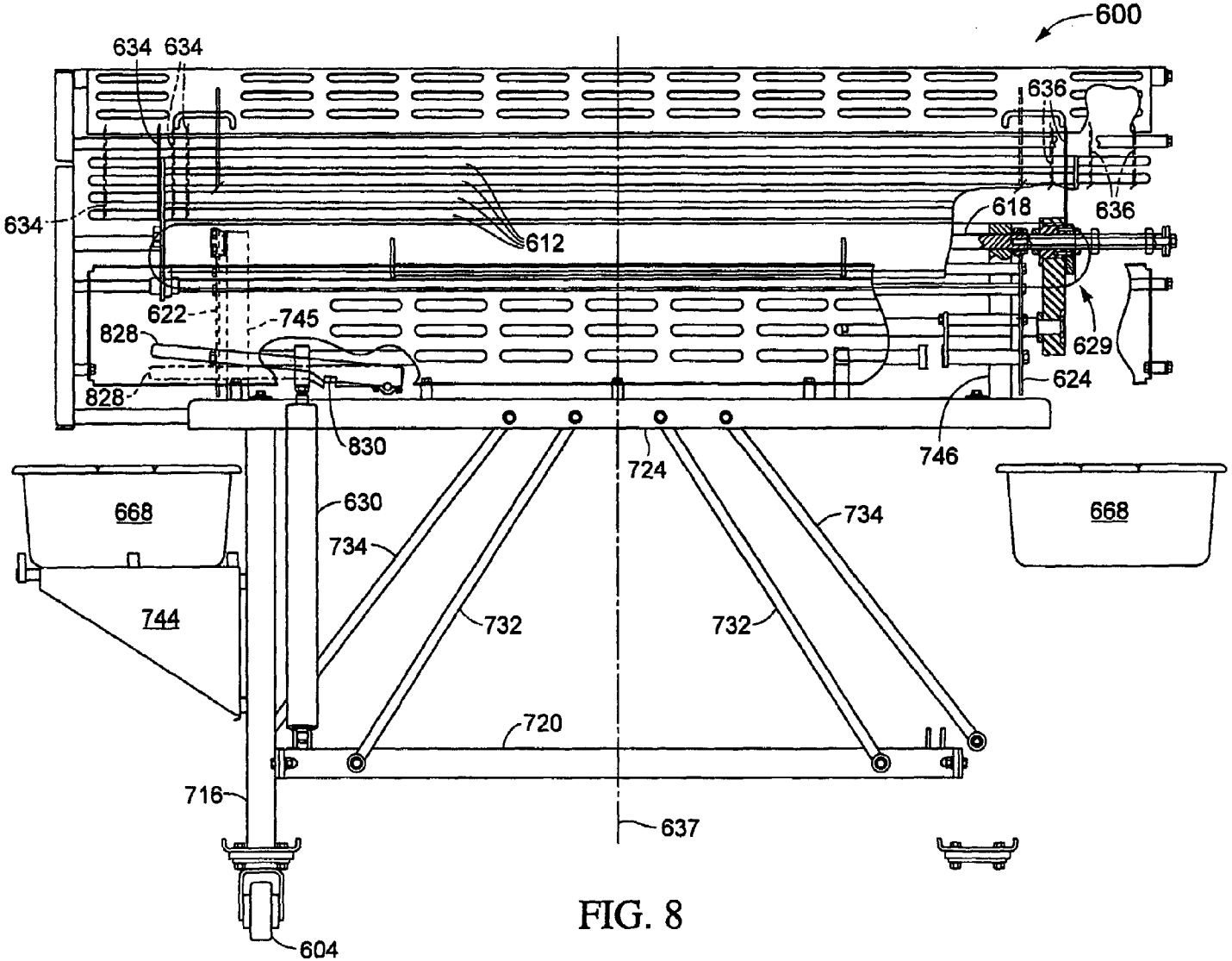
FIG. 8 is a front view of the loaf trimming station shown in FIG. 7 with portions removed to show inside components.

The station 600 is substantially mirror image identical in construction across a vertical center line 637 shown in FIG. 8. Therefore, only the right side is described in detail with the understanding that the left side is mirror image identical, except where noted, such as with regard to the connection arrangement 800 and the controls.

Figure 8A:
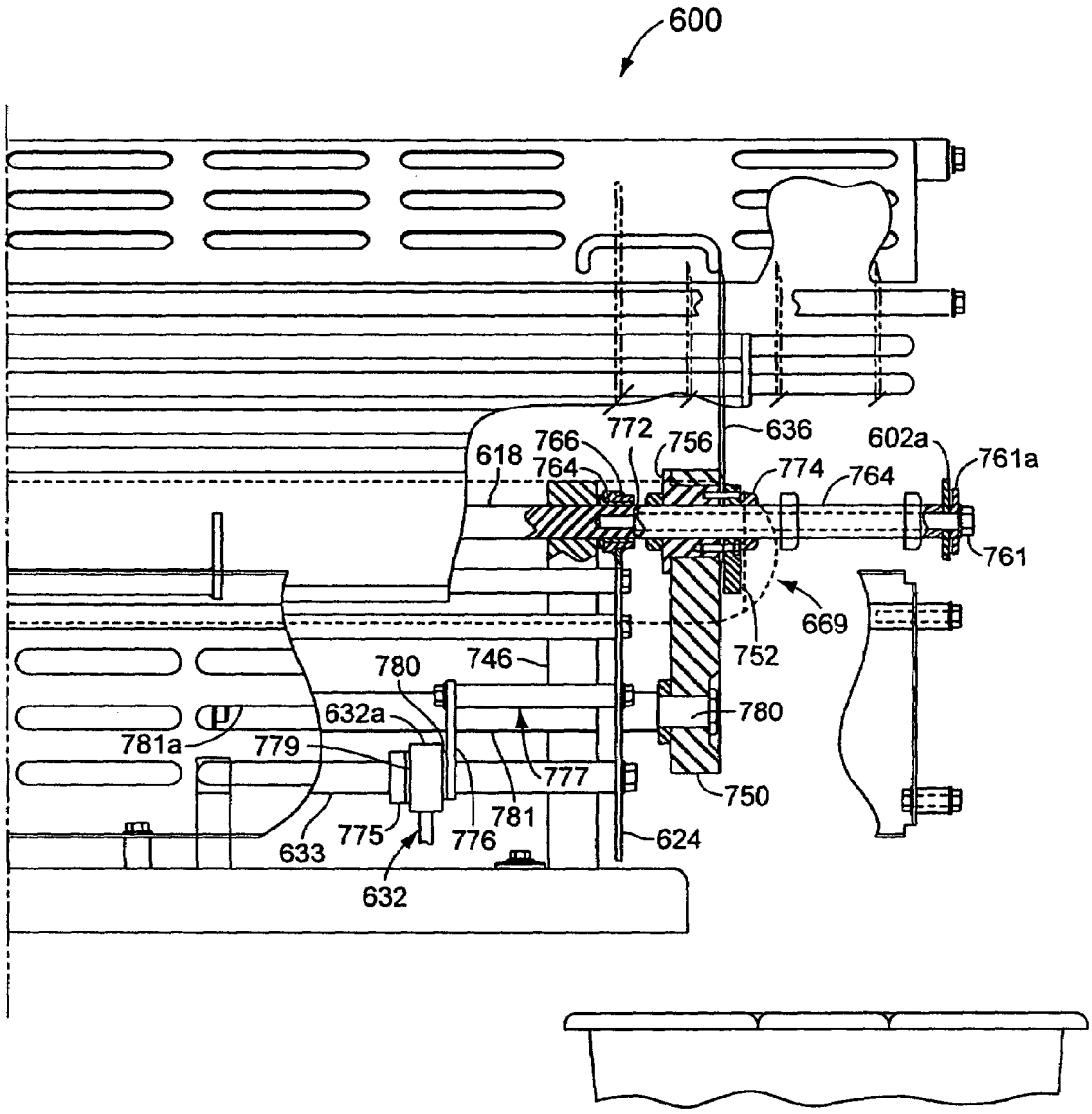
FIG. 8A is an enlarged portion taken from FIG. 8.
Figure 10A:
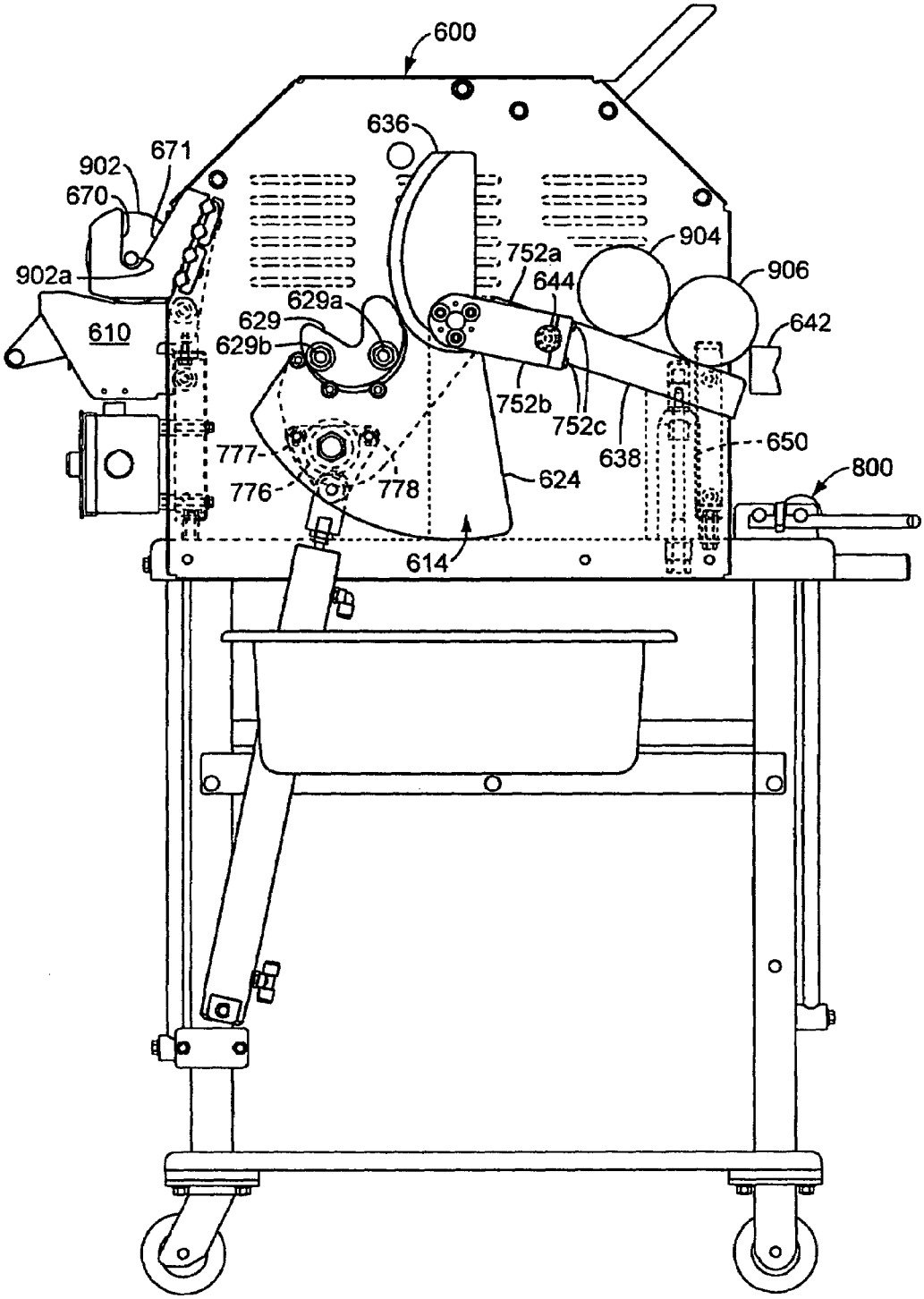
FIGS. 10A-10D are right side views of the trimming station similar to FIG. 6 showing a progression of loaf trimming steps.

FIGS. 8 and 8A illustrate the knives 634, 636 as well as adjustable longitudinal positions of the knives 634, 636, shown by dashed outlines. The knife 636 is rotationally mounted to a plastic shear edge block 750 via a plate 752 and a hub 756. The knife 636 is pinned and fastened fixedly to the plate 752 and to the hub 756. The hub 756 is fit within a hole in the block 750 so that the block 750 can rotate about the hub 756. A tube 764 having an outside threading and an inside bore freely penetrates through the plate 752 and hub 756 and is axially fixed to the shaft 618 by a long bolt 761 penetrating through the bore of the tube 764. The bolt 761 is tightly engaged into a threaded end bore of the shaft 618. The head end of the bolt 761 clamps a washer 761*a* to a portion of the frame 602*a* (such as to a frame sidewall) to stabilize the tube 764. The knife 636, the tube 764, the bolt 761, the plate 752, the hub 756 and the shaft 760 are rotationally stationary during operation. The shear edge block 750 and the plate 624 swing during operation. The plate 752 includes an extending portion 752*a* that extends to the shaft 644 as shown in FIG. 10A, and is held to the shaft 644 by a clamp plate or end cap 752*b* and two fasteners 752*c*. This prevents rotary deflection of the knife under contact pressure from the loaf being cut. The opening formed by the plate 752 and the clamp plate 752*b* around the shaft 644 is large enough to allow the blade assembly to slide longitudinally along the shaft 644 and tube 764 for blade positioning adjustment. The shaft 618 is rotationally guided and supported by the block 746, and includes a journal portion 764 that is surrounded by a collar 766. The collar 766 rotates on the journal portion 764. The collar 766 is welded to the plate 624.

As an alternate embodiment the end cap 752*b* and fasteners 752*c* can be eliminated and the extending portion 752*a* can have a slot formed into its end face that captures the shaft 644.

The knife 636 can be relocated axially along the tube 764 by loosening opposing lock nuts 772, 774 and sliding the block 750 including the parts 756, 752 and 636, along the tube and retightening the locknuts 772, 774.

A bolt 780 fixes a stub shaft 781 to the shear edge block 750. The stub shaft 781 slidingly but closely fits through a hole in the plate 624. The stub shaft 781 has a length to its end 781*a* to allow for adjustment of the longitudinal position of the knife 636 and shear edge block 750 with respect to the plate 624.

The pneumatic cylinder 632 is rotationally engaged to the shaft 633 between a shaft clamp 775 and a triangular plate 776. The triangular plate 776 is fixed via two spacer/fastener assemblies 777, 778 to the plate 624. The shaft 633 is fixed to the end plate 624 by an end fastener. The shaft 633 with close clearance passes through the triangular plate 776 to ensure a reduced friction movement between the connection 632*a* and the shaft 633. A pair of thrust washers 779, 780 can be fit between the pneumatic cylinder connection 632*a* and the clamp and the pneumatic connection 632*a* and the triangular plate 776. This arrangement sets the longitudinal location of the connection 632*a* on the shaft 633.

When the shaft 633 is forcibly swung by the cylinders 630, 632, the plates 622, 624 and the two triangular plates 776 (one on each side of the machine) are swung. The two stub shafts 781 (one on each side of the machine) are rotated by force from the four plates 622, 624, 776. The two shear edge blocks 750 (one on each side of the machine) are then rotated with the plates 622, 624, 776 via force from the two stub shafts 781. The plastic shear edge blocks ensure a smooth, close slice along the knives 634, 636.

Figure 9:
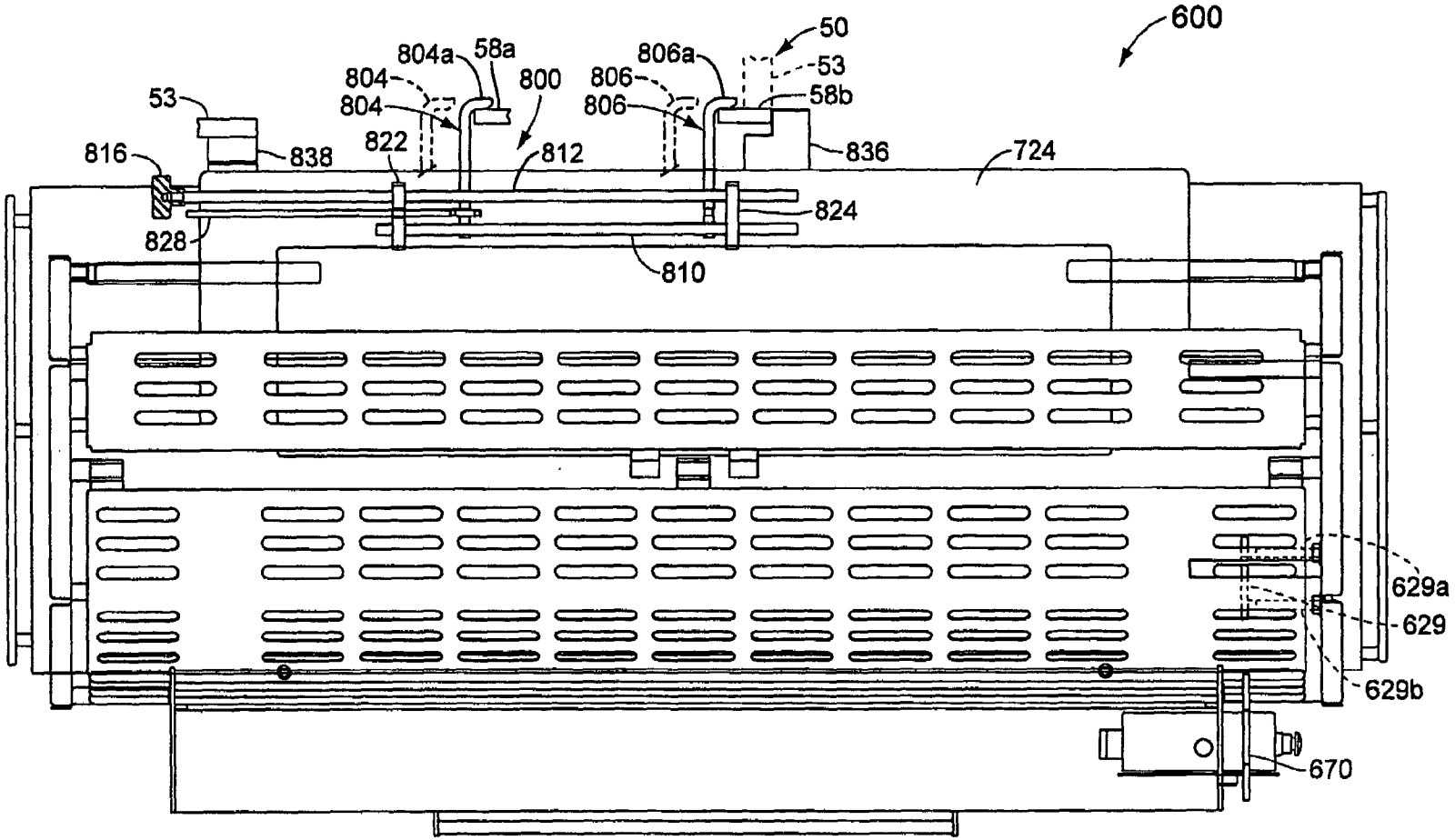
FIG. 9 is a top view of the loaf trimming station shown in FIG. 6.

FIG. 9 illustrates a mechanism 800 used for attaching the slicing apparatus 600 to the slicing machine 50. The mechanism 800 includes a pair of hook rods 804, 806 having turned ends 804*a*, 806*a*. The hook rods 804, 806 are welded to parallel rods 810, 812 to form an integrated frame. One of the parallel rods 812 is longer and is provided with a knob 816. The rods 810, 812 are guided for sliding movement by blocks 822, 824 that are mounted to the top platform 724 of the station 600. A locking lever 828 is pivotally mounted to the hook rod 804. The lever 828 includes a notch 830 (FIG. 8) that is sized to fit over, and engage, the block 822.

To lock the station 600 to the slicing machine 50, the rods 810, 812 and thus the hook rods 804, 806 are slid to the solid line positions shown in FIG. 9 from the dashed line positions shown as 804, 806. The hook ends 804*a*, 806*a* fit behind portions 58*a*, 58*b* of the top of the base 51. An L-shaped block 836 fixed to a back side of the top platform 724 abuts a side and end of the slicing machine enclosure 53. A further block 838 abuts a side portion of the enclosure 53. The hook ends 804*a*, 806*a* effectively clamp the portions 58*a*, 58*b* and portions of the enclosure 53 against the blocks 836, 838, to prevent any relative movement of the station 600 toward or away from the slicing machine 50. The block 836 also locks the longitudinal position of the station 600 with respect to the slicing machine 50 in cooperation with the hook bars 804, 806. Once the hook ends 804*a*, 806*a* are engaged, the lever 828 is locked down with the notch 830 engaging the block 822 which prevents longitudinal movement of the hook bars 804, 806 and disengagement of the ends 804*a*, 806*a*.

FIGS. 10A-10D illustrate the use of the trimming station 600. First, a loaf 902 to be trimmed is placed on the open door 610. An end closure or tie-off 902*a* is shown on the loaf 902, the end closure of being accommodated by the notch 671 in the end stop 670. FIG. 10A illustrates loaves 904, 906 that have already been trimmed and are on the output tray 638. The output tray 638 is tilted downward so that the first loaf 906 is pressed against the lip 642 of the loaf window 93.

Figure 10B:
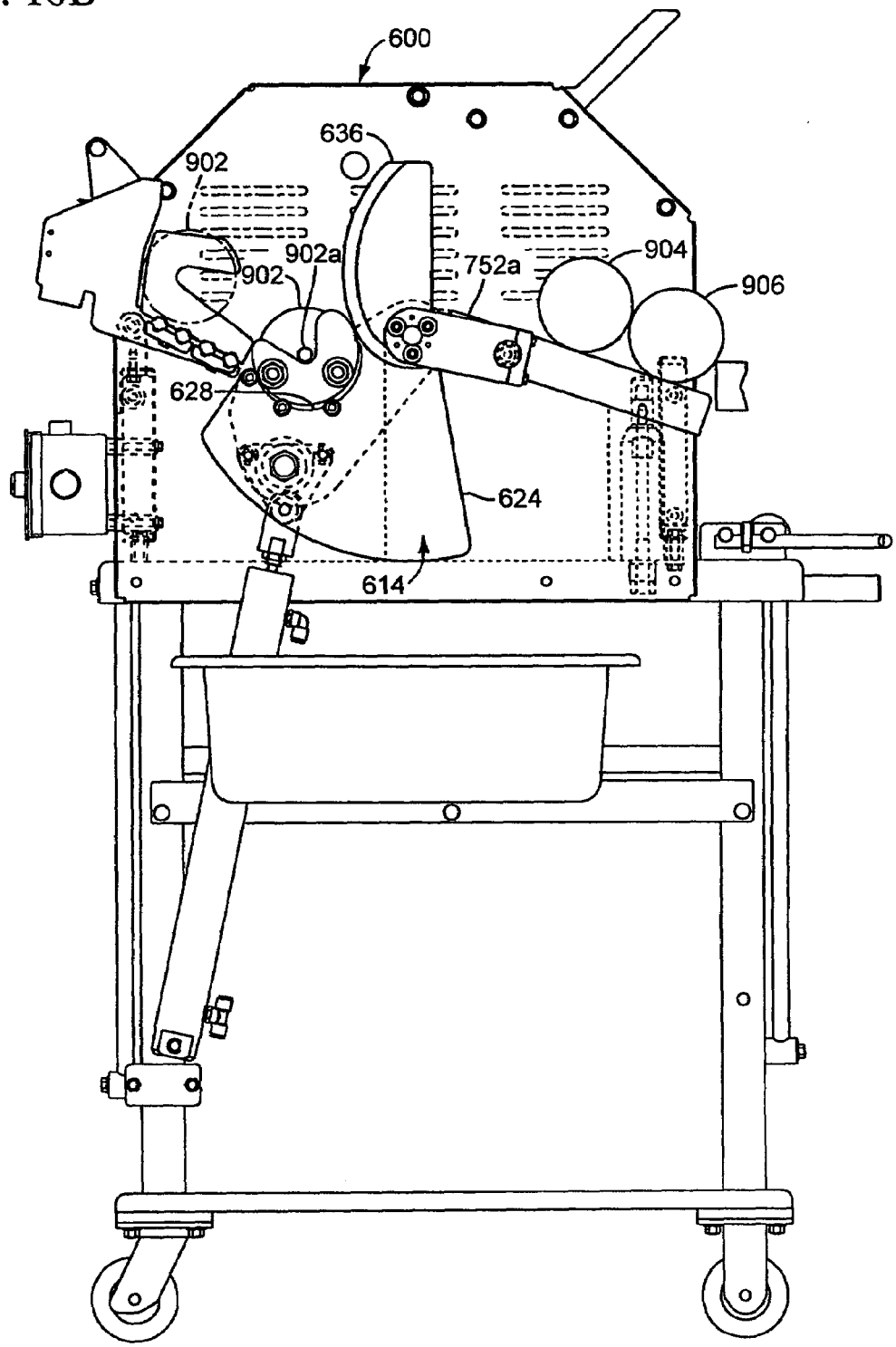

FIG. 10B illustrates the door 610 closed and the loaf 902 has dropped or rolled from the door bars 612 to the trimming cradle 628.

The stop plate 629 is adjustably mounted by two threaded rods 629*a*, 629*b* to a side wall of the station and can have its distance to the cradle 628 adjusted. The stop plate 629 is aligned longitudinally with the end stop 670. In effect, in operation, the end stop 670 "hands-off" the end of the loaf to the stop plate 629. The stop plate 629 has a V or U-shaped notch for receiving the end closure of the loaf for the reasons set forth below with respect to the end stop 670. Although FIG. 9 locates the end stop 670 and the stop plate 629 on a right side of the station 600 to set the trailing end of the loaf, both could alternately be located on the left side, to set the leading end of the loaf.

Figure 10C:
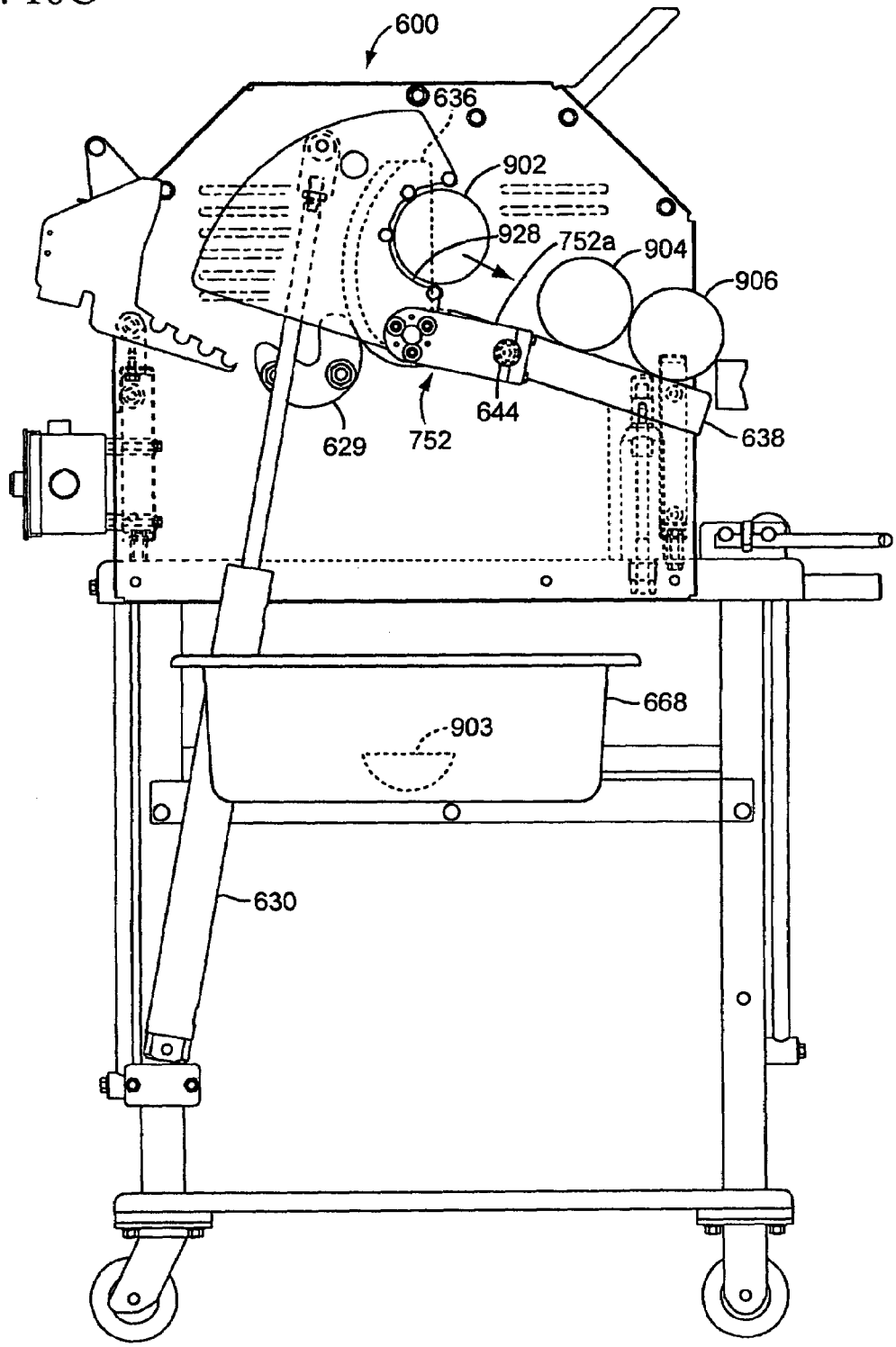

FIG. 10C illustrates the pneumatic cylinders 630, 632 have been extended, pivoting the trimming support 614 and driving the loaf 902 through the knives 634, 636 to remove loaf ends 903 which fall into the bins 668. The loaf 902 falls from the cradle 628 onto the tray 638 and rolls against the preceding loaf 904 as shown in FIG. 10D.

Figure 10D:
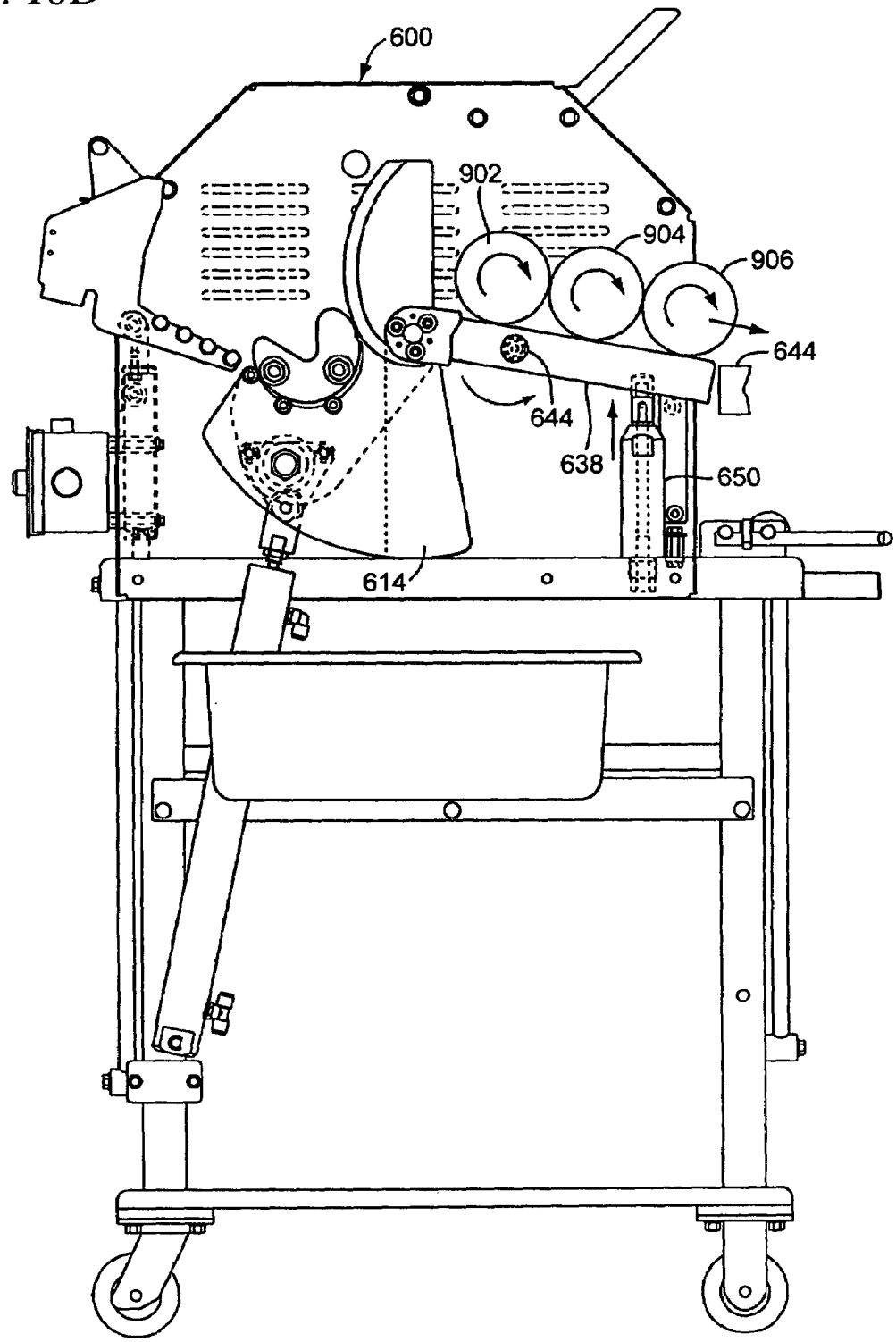

FIG. 10D illustrates that the output tray 638 has been tilted about its axis 644 by the pneumatic cylinders 650, 652 such that the loaves 902, 904, 906 roll by force of gravity down the output tray 638, over the lip 644, through the window 93 and onto the lift tray 85 (not shown). The trimming support 614 has been rotated back to a load position.

The system includes a control panel 912 having an operating button 914 that activates the cylinders 630, 632 to trim a loaf. The system may include sensors to determine that sense the presence of three loaves on the output tray 638. The slicing apparatus controller receives the signal and when the lift tray 85 is at a loading position, triggers the cylinders 650, 652 to tilt the tray 638 to deliver the loaves to the lift tray 85. Once the loaves are delivered to the lift tray 85 an operator can trigger the lift operation manually with a button on the slicing machine or on the control panel 912.

A proximity sensor 920 located on the control panel 912 senses a target 924 located on the door 610. If the door is open, the presence of the target disables the trim control button 914. A further sensor and target arrangement 926 is located on and adjacent to the lid 750 which also disables the button 914 if the lid is open. A third sensor and target arrangement 932 is arranged between and on the slicing machine 50 and station 600 which disables the button 914 if the station 600 is not engaged to the slicing machine 50.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. An improved high speed food loaf slicing machine, comprising:

a slicing station including a knife blade and a knife blade drive driving the knife blade along a predetermined cutting path, and loaf support means for supporting a food loaf into the slicing station for repetitive slicing of said loaf by the knife blade;

a loaf feed drive for advancing the food loaf along the loaf path at a feed rate; and a trimming station located adjacent to said slicing station and comprising a frame, a first knife and a second knife spaced apart along said frame and oriented in positions corresponding to a lead end trimming location and a trailing end trimming location of a food loaf, a loaf cutting support for receiving said loaf, and a motive mechanism to move said loaf cutting support toward said knives to trim end portions off of said loaf to provide a trimmed loaf, and a delivery mechanism for delivering said trimmed loaf to said slicing station, wherein said loaf cutting support is pivotally mounted on said frame, and said knives are fixedly mounted to said frame, and wherein said motive mechanism comprises a pneumatic cylinder connected between said loaf cutting support and said frame, a change in length of said pneumatic cylinder pivoting said loaf cutting support to drive said knives through said loaf held thereon.

2. An improved high speed food loaf slicing machine according to claim 1, wherein said delivery mechanism comprises a loaf staging support wherein said loaf cutting support deposits the loaves on said loaf staging support after being trimmed by said knives, said loaf staging support movable between a staging position to collect trimmed loaves and a loading position to deliver trimmed loaves to said cutting path.

3. An improved high speed food loaf slicing machine according to claim 1, wherein said cutting path holds plural loaves side-by-side, and comprising plural loaf feed drives that drive said loaves independently into the cutting plane.

4. An improved high speed food loaf slicing machine according to claim 3, wherein said slicing station comprises a loaf loading tray for receiving loaves from said staging support, a loading mechanism for moving said loaf loading tray to a position adjacent to said cutting path, and a displacement mechanism for moving said loaves from said loaf loading tray to said cutting path.

5. An improved high speed food loaf slicing machine according to claim 1, wherein said knives are adjustable in position on said frame along a direction along the length of said loaf held on said loaf cutting support.

6. An improved high speed food loaf slicing machine according to claim 1, comprising an end stop on said loaf cutting support, said end stop arranged to abut an end of a loaf set on said loaf cutting support, said end stop being adjustable in position on said loaf cutting support along a direction along a length of said loaf held on said loaf cutting support.

7. An improved high speed food loaf slicing machine according to claim 1, wherein said knives are non-rotational, fixed blades.

8. An improved high speed food loaf slicing machine, comprising:

a slicing station including a knife blade and a knife blade drive driving the knife blade along a predetermined cutting path, and loaf support means for supporting a food loaf into the slicing station for repetitive slicing of said loaf by the knife blade;

a loaf feed drive for advancing the food loaf along the loaf path at a feed rate; and a trimming station located adjacent to said slicing station and comprising a frame, a first knife and a second knife spaced apart along said frame and oriented in positions corresponding to a lead end trimming location and a trailing end trimming location of a food loaf, a loaf cutting support for receiving said loaf, and a motive mechanism to move said loaf cutting support toward said knives to trim end portions off of said loaf to provide a trimmed loaf, and a delivery mechanism for delivering said trimmed loaf to said slicing station; and wherein said loaf cutting support is movably mounted on said frame, and said knives are mounted in a fixed position on said frame, and wherein said motive mechanism comprises a pneumatic cylinder connected between said loaf cutting support and said frame, a change in length of said pneumatic cylinder pivoting said loaf cutting support to drive said knives through said loaf held thereon; and wherein said knives are adjustable in position on said frame along a direction along the length of said loaf held on said loaf cutting support.

9. An improved high speed food loaf slicing machine according to claim 8, comprising an end stop on said loaf cutting support, said end stop arranged to abut an end of a loaf set on said loaf cutting support, said end stop being adjustable in position on said loaf cutting support along a direction along a length of said loaf held on said loaf cutting support.

10. An improved high speed food loaf slicing machine according to claim 8, wherein said knives are non-rotational, fixed blades.

11. A trimming apparatus for food loaves, comprising:

a frame;

a first knife and a second knife spaced apart along said frame and oriented in positions corresponding to a lead end trimming location and a trailing end trimming location of a food loaf;

a loaf cutting support for receiving said loaf; and a motive mechanism to move said loaf cutting support toward said knives to trim end portions off of said loaf; and a loaf staging support wherein said loaf cutting support deposits the loaves on said loaf staging support after being trimmed by said knives, said loaf staging support movable between a staging position to collect trimmed loaves and a loading position to discharge loaves;

wherein said loaf cutting support is pivotally mounted on said frame, and said knives are mounted to said frame, and wherein said motive mechanism comprises a pneumatic cylinder connected between said loaf cutting support and said frame, a change in length of said pneumatic cylinder pivoting said loaf cutting support to drive said knives through said loaf held thereon;

wherein said knives are adjustable in position on said frame along a direction along the length of said loaf held on said loaf cutting support; and comprising an end stop on said loaf cutting support, said end stop arranged to abut an end of a loaf set on said loaf cutting support, said end stop being adjustable in position on said loaf cutting support along a direction along a length of said loaf held on said loaf cutting support.

12. A trimming apparatus according to claim 11, wherein said knives are non-rotational fixed blades.

13. An improved high speed food loaf slicing machine, comprising:

a slicing station including a knife blade and a knife blade drive driving the knife blade along a predetermined cutting path, and loaf support means for supporting a food loaf into the slicing station for repetitive slicing of said loaf by the knife blade;

a loaf feed drive for advancing the food loaf along the loaf path at a feed rate; and a trimming station located adjacent to said slicing station and comprising a frame, a first knife and a second knife spaced apart along said frame and oriented in positions corresponding to a lead end trimming location and a trailing end trimming location of a food loaf, a loaf cutting support for receiving said loaf, and a motive mechanism to move said loaf cutting support toward said knives to trim end portions off of said loaf to provide a trimmed loaf, and a delivery mechanism for delivering said trimmed loaf to said slicing station; and a loaf staging support wherein said loaf cutting support deposits the loaves on said loaf staging support after being trimmed by said knives, said loaf staging support movable between a staging position to collect trimmed loaves and a loading position to discharge loaves;

wherein said loaf cutting support is pivotally mounted on said frame, and said knives are mounted to said frame, and wherein said motive mechanism comprises a pneumatic cylinder connected between said loaf cutting support and said frame, a change in length of said pneumatic cylinder pivoting said loaf cutting support to drive said knives through said loaf held thereon;

wherein said knives are adjustable in position on said frame along a direction along the length of said loaf held on said loaf cutting support; and comprising an end stop on said loaf cutting support, said end stop arranged to abut an end of a loaf set on said loaf cutting support, said end stop being adjustable in position on said loaf cutting support along a direction along a length of said loaf held on said loaf cutting support.

14. An improved high speed food loaf slicing machine according to claim 13, wherein said knives are non-rotational fixed blades.

* * * * *

UNITED STATES PATENT AND TRADEMARK OFFICE

CERTIFICATE OF CORRECTION

PATENT NO. : 7,299,728 B2
APPLICATION NO. : 11/112969
DATED : November 27, 2007
INVENTOR(S) : Judd Ferrin et al.

It is certified that error appears in the above-identified patent and that said Letters Patent is hereby corrected as shown below:

At column 1, line 13, change "committed" to --comminuted--.

At column 2, line 54, change "44" to --4-4--.

Signed and Sealed this
Ninth Day of August, 2011

David J. Kappos

David J. Kappos
*Director of the United States Patent and Trademark Office*